US008712285B2

(12) United States Patent
Kato

(10) Patent No.: US 8,712,285 B2
(45) Date of Patent: Apr. 29, 2014

(54) IMAGE FORMING APPARATUS

(75) Inventor: Atsushi Kato, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 261 days.

(21) Appl. No.: 13/360,488

(22) Filed: Jan. 27, 2012

(65) Prior Publication Data

US 2012/0195628 A1 Aug. 2, 2012

(30) Foreign Application Priority Data

Jan. 28, 2011 (JP) ..... 2011-016428

(51) Int. Cl.
*G03G 21/18* (2006.01)
*G03G 15/00* (2006.01)
*G03G 21/16* (2006.01)

(52) U.S. Cl.
CPC ..... *G03G 21/1832* (2013.01)
USPC ..... 399/114; 399/110; 399/111

(58) Field of Classification Search
CPC ..... G03G 21/1832
USPC ..... 399/110, 111, 114, 102
See application file for complete search history.

(56) References Cited

U.S. PATENT DOCUMENTS 4,737,817 A * 4/1988 Kando et al. ..... 399/114
7,164,876 B2 * 1/2007 Yoo et al. ..... 399/116
2005/0135832 A1 * 6/2005 Kubota et al. ..... 399/90
2009/0208245 A1 * 8/2009 Sato ..... 399/111
2010/0054800 A1 3/2010 Okabe
2011/0217068 A1 * 9/2011 Kamimura et al. ..... 399/110

FOREIGN PATENT DOCUMENTS

JP 2008-090121 A 4/2008
JP 2010-054837 A 3/2010
JP 2010-151952 A 7/2010

* cited by examiner

*Primary Examiner* — Walter L Lindsay, Jr.
*Assistant Examiner* — Rodney Bonnette
(74) *Attorney, Agent, or Firm* — Baker Botts L.L.P.

(57) ABSTRACT

An image forming apparatus is provided. The image forming apparatus includes plural cartridges and a cartridge holder which integrally supports cartridges and is movable in an alignment direction of the cartridges between an outer position and an inner position relative to the apparatus main body. Each cartridge includes a developer carrier, a handle member which is displaceable between a protrusion position of protruding upward and a retreat position below the protrusion position, and a cover member which is displaceable between a close position of covering an upper part of the developer carrier and an open position of opening the upper part of the developer carrier. At least the cartridges are provided with an interlocking mechanism which is configured to displace each of the handle members and the cover members in conjunction with moving the cartridge holder with respect to the apparatus main body.

14 Claims, 11 Drawing Sheets

IMAGE FORMING APPARATUS

CROSS-REFERENCE TO RELATED APPLICATION

This application claims priority from Japanese Patent Application No. 2011-016428, filed on Jan. 28, 2011, the entire subject matter of which is incorporated herein by reference.

TECHNICAL FIELD

Aspects of the present invention relate to an image forming apparatus having a cartridge holder which integrally supports a plurality of cartridges.

BACKGROUND

There has been known an image forming apparatus including a plurality of cartridges which are arranged in parallel in a predetermined direction, and a cartridge holder which integrally supports the cartridges and is mounted to an apparatus main body such that it can be withdrawn from the apparatus main body in the predetermined direction (for example, see JP 2010-054837). Specifically, according to this technique, each cartridge is provided with a handle member protruding upward. A user can remove each cartridge with holding the handle member after withdrawing the cartridge holder.

However, according to the above configuration, when the cartridge holder is accommodated in the apparatus main body, the handle member is left with protruding upward. Accordingly, it is necessary to prepare a large space for accommodating the handle member in the apparatus main body, so that the size of the apparatus cannot be reduced.

SUMMARY

Accordingly, it is an aspect of the present invention to provide an image forming apparatus capable of reducing the size of the apparatus.

According to an illustrative embodiment of the present invention, there is provided an image forming apparatus comprising: an apparatus main body; a plurality of cartridges which are aligned in an alignment direction; and a cartridge holder which is configured to integrally support the plurality of cartridges and is configured to be moved in the alignment direction between an outer position located at an outside of the apparatus main body and an inner position located at an inside of the apparatus main body. Each of the cartridges includes: a casing having an opening which is open upward; a developer carrier which is configured to carry developer and is exposed upward through the opening; a handle member which is configured to be displaced between a protrusion position where the handle member protrudes upward above the opening and a retreat position where the handle member is below the protrusion position; and a cover member which is configured to be displaced between a close position of covering an upper part of the developer carrier and an open position of opening the upper part of the developer carrier. Among the cartridges and the cartridge holder, at least the cartridges are provided with an interlocking mechanism which is configured to displace each of the handle members and the cover members in conjunction with moving of the cartridge holder with respect to the apparatus main body. The interlocking mechanism is configured to displace each of the handle members to the retreat position and each of the cover members to the open position in conjunction with the moving of the cartridge holder to the inner position with respect to the apparatus main body. The interlocking mechanism is configured to displace each of the handle members to the protrusion position and each of the cover members to the close position in conjunction with the moving of the cartridge holder to the outer position with respect to the apparatus main body.

According to the above configuration, when the cartridge holder is moved to the inner position, the handle member is displaced to the retreat position. Therefore, it is possible to reduce the size of the apparatus, compared to a configuration where the handle member is accommodated in the apparatus main body with protruding upward.

BRIEF DESCRIPTION OF THE DRAWINGS

The above and other aspects of the present invention will become more apparent and more readily appreciated from the following description of illustrative embodiments of the present invention taken in conjunction with the attached drawings, in which:

FIGS. 8A and 8B are simplified views showing the interlocking mechanism, wherein FIG. 8A shows a state where the handle member is located, at the protrusion position and FIG. 8B shows a state where the handle member is located at the retreat position;

DETAILED DESCRIPTION

<Overall Configuration of Color Printer>

Hereinafter, illustrative embodiments of the present invention will be specifically described with reference to the drawings. In the below descriptions, the directions are described, on the basis of a user who uses a color printer. That is, in FIG. 1, the right side is referred to as the 'front side', the left side is referred to as the 'rear side', the front side is referred to as the 'left side' and the back side is referred to as the 'right side.' Also, an upper-lower direction of FIG. 1 is referred to as the 'upper-lower direction.'

Figure 1:
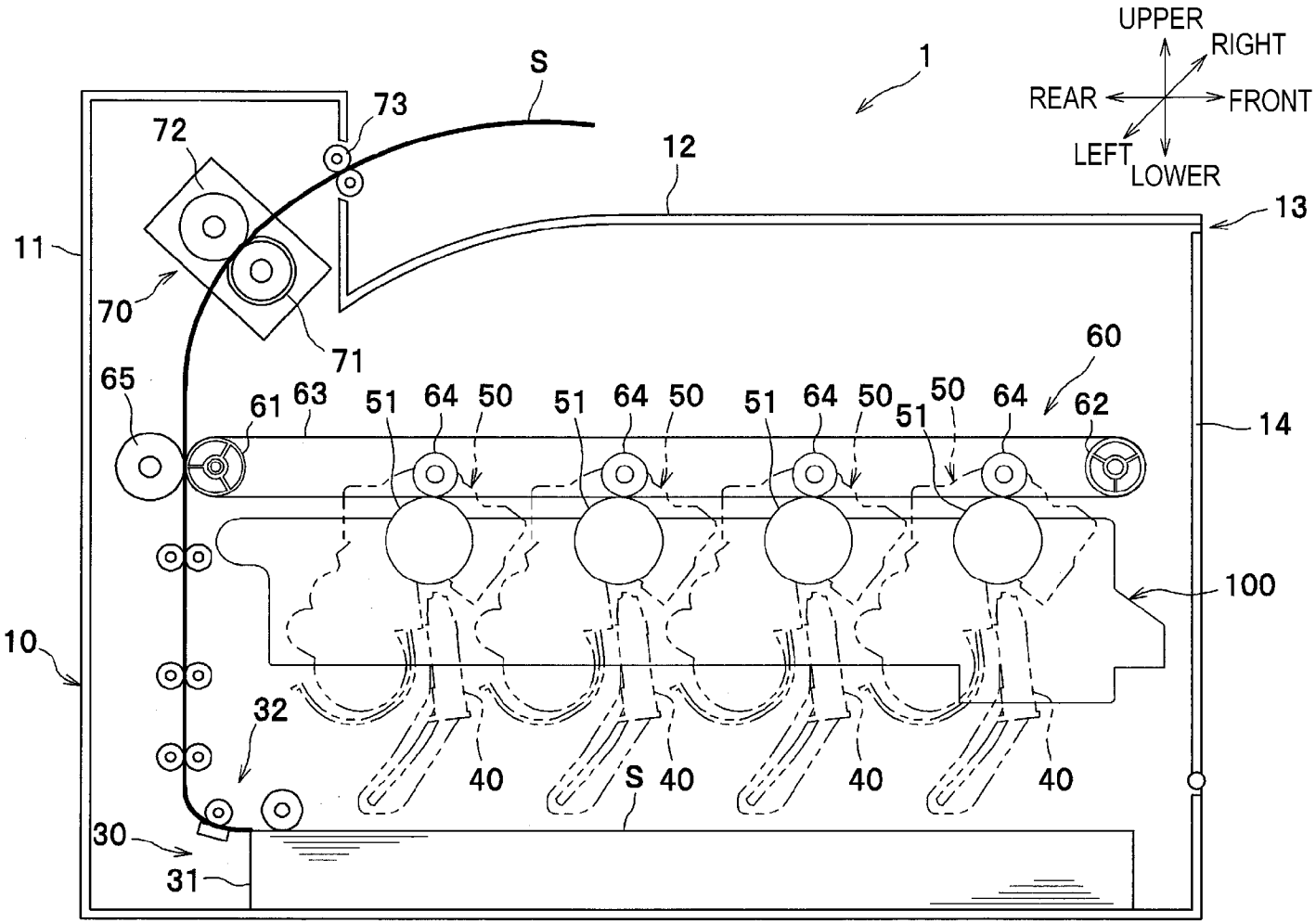
FIG. 1 is a view schematically showing a color printer according to an illustrative embodiment of the present invention when a cartridge holder is located at an inner position.

As shown in FIG. 1, a color printer 1 (an example of an image forming apparatus) includes, in an apparatus main body 10, a feeing unit 30, four LED units 40, four process cartridges 50, a cartridge holder 100 which is configured to integrally support the four process cartridges 50, a transfer unit 60 and a fixing unit 70.

As shown in FIG. 1, a sheet discharge tray 12 on which sheets S discharged from the apparatus main body 10 are placed and stacked is provided at an upper part of the apparatus main body 10. Also, a front wall of the apparatus main body 10 is formed with an opening 13 for withdrawing the cartridge holder 100 to the outside of the apparatus main body 10 and is rotatably provided with a front cover 14 for opening and closing the opening 13.

The feeing unit 30 is provided at a lower part in the apparatus main body 10 and includes a sheet feeding tray 31 which accommodates therein sheets S and a sheet feeding mechanism 32 which conveys the sheet S from the sheet feeding tray 31 to a transfer position (between an intermediate transfer belt 63 and a secondary transfer roller 65). The sheets S in the sheet feeding tray 31 are separated one by one by the sheet feeding mechanism 32 and then conveyed to the transfer position.

The LED unit 40 is arranged below a photosensitive drum 51 (an example of the developer carrier) to oppose the photosensitive drum 51 and includes a plurality of light emitting diodes (LEDs) (not shown) at a tip end thereof. The LEDs are arranged in an axial direction (left-right direction) of the photosensitive drum 51. The LED unit 40 turns on and off the light emitting diodes based on image data, thereby exposing a surface of the photosensitive drum 51.

The LED units 40 are arranged at positions (exposure positions) adjacent to the process cartridges 50 in the front-rear direction. When the front cover 14 is opened, the LED units 40 are moved downward while tilting and are thus retracted to positions at which they do not overlap with the respective process cartridges 50, when seen from the front-rear direction. Thereby, when the front cover 14 is opened, it is possible to withdraw the cartridge holder 100 while the LED units 40 and the process cartridges 50 do not interfere with each other. In the meantime, when the front cover 14 is closed, the respective LED units 40 are moved upward while tilting and are thus returned to the exposure positions.

Figure 3:
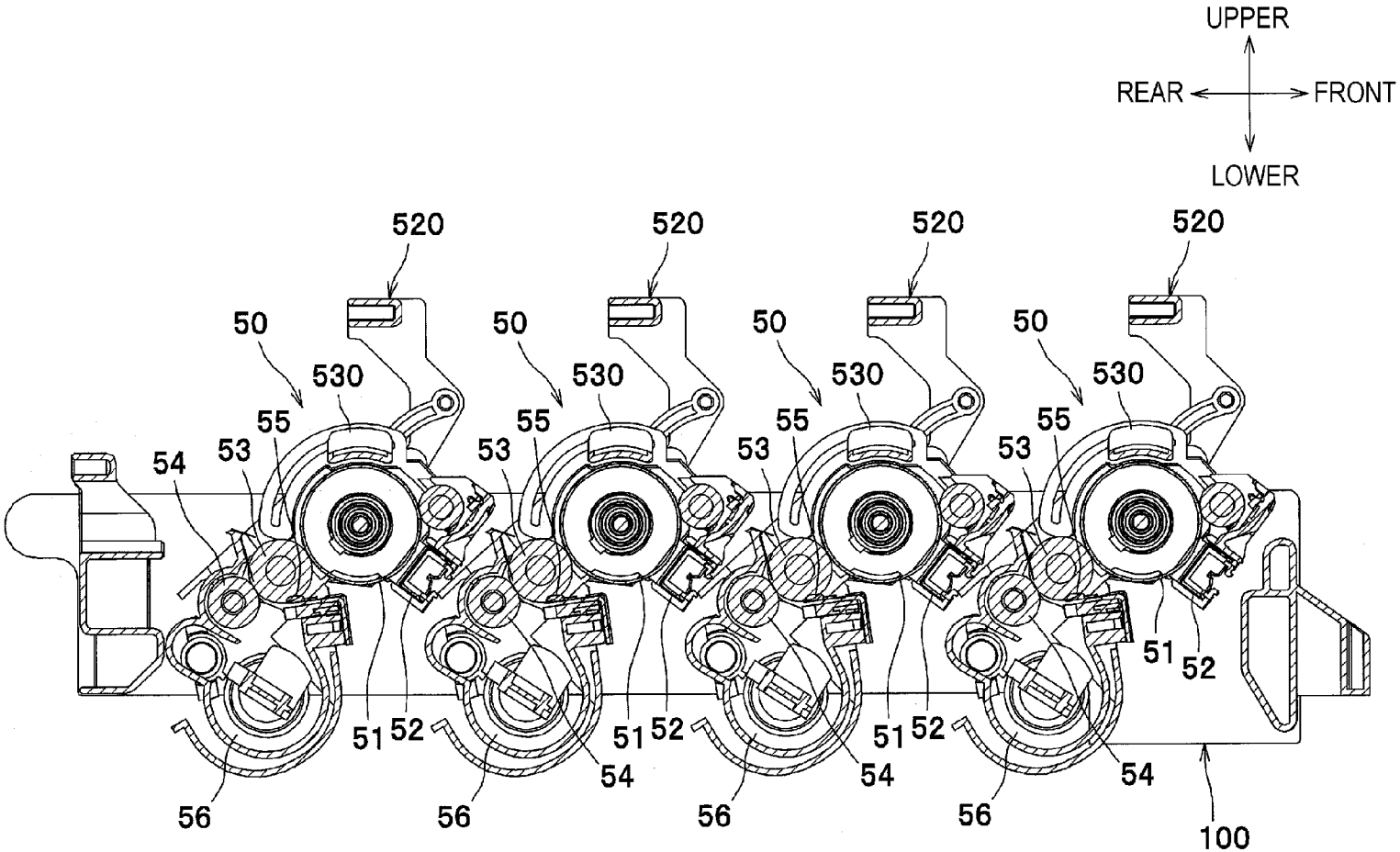
FIG. 3 is a sectional view showing the cartridge holder located at the outer position and each of process cartridges.

The process cartridges 50 are aligned in the front-rear direction (an example of an alignment direction) at the upper part of the feeing unit 30. Each of the process cartridges 50 includes the photosensitive drum 51, a charger 52, a developing roller 53, a supply roller 54, a layer-thickness regulation blade 55, a toner accommodation chamber 56 (refer to FIG. 3) and the like. The detailed configuration of the process cartridge 50 will be described later.

Figure 2:
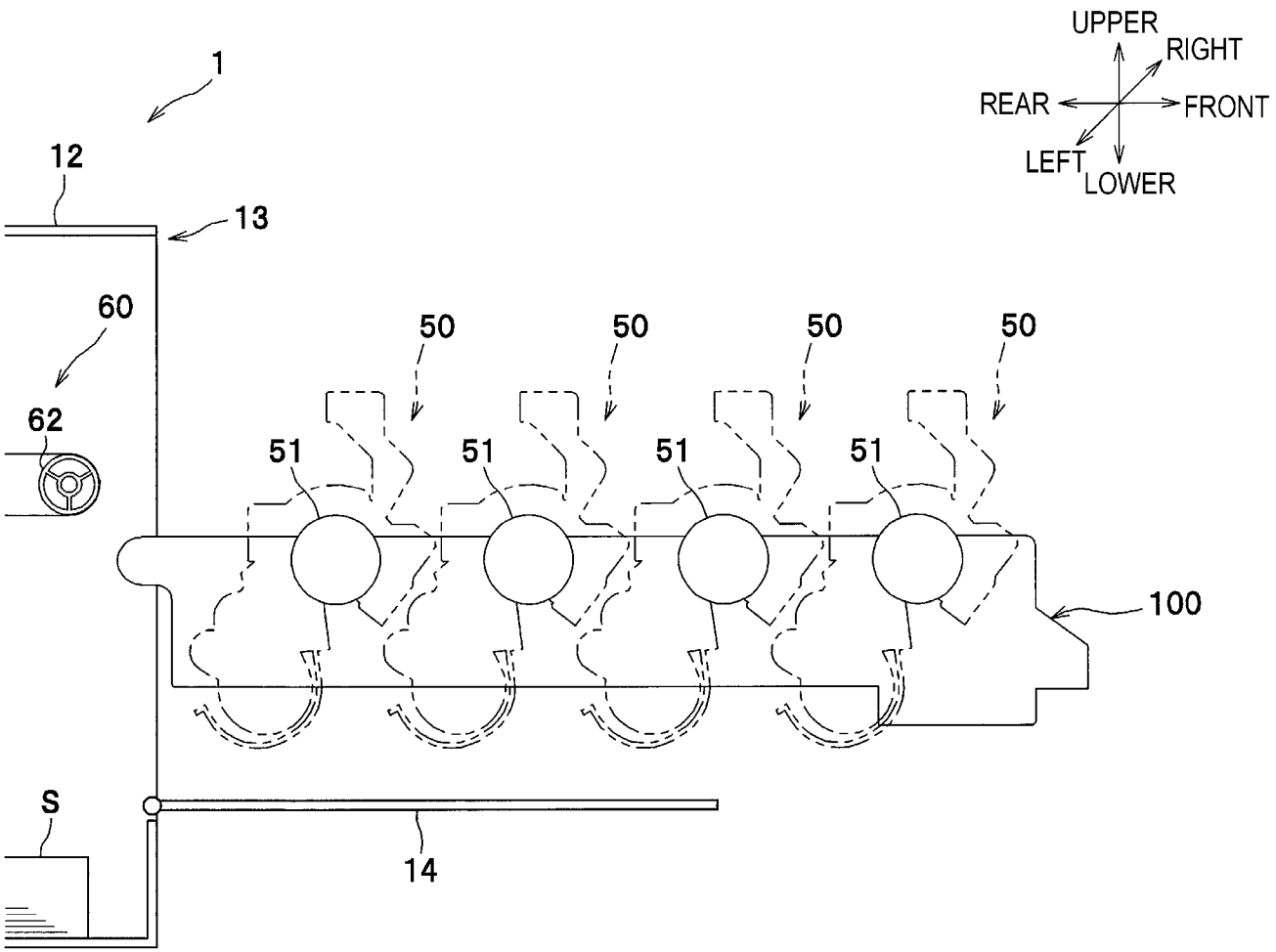
FIG. 2 is a view showing a state when the cartridge holder is located at an outer position.

The cartridge holder 100 is supported to the apparatus main body 10 to be movable in the front-rear direction, and is configured to be moved between an outer position (position shown in FIG. 2) located at an outside of the apparatus main body 10 and an inner position (position shown in FIG. 1) located an inside of the apparatus main body 10. The cartridge holder 100 may be removably mounted to the apparatus main body 10 or may be configured no to be separated from the apparatus main body 10 without using a tool and the like.

The transfer unit 60 is provided above the process cartridges 50 and includes a driving roller 61, a driven roller 62, an endless intermediate transfer belt 63, four primary transfer rollers 64 which are arranged to oppose the photosensitive drums 51, respectively, via the intermediate transfer belt 63, and a secondary transfer roller 65 which is arranged to oppose the driving roller 61 via the intermediate transfer belt 63.

In the process cartridges 50 and the transfer unit 60, the surfaces of the photosensitive drums 51 are uniformly charged by the chargers 52 and then exposed by the LED units 40, so that electrostatic latent images based on the image data are formed on the photosensitive drums 51, respectively. Toner in the toner accommodation chambers 56 is carried on surfaces of the developing rollers 53 via the supply rollers 54, respectively.

The toner carried on the surfaces of the developing rollers 53 are supplied front the developing rollers 53 to the electrostatic latent images of the photosensitive drums 51. Thereby, the electrostatic latent images become visible, so that toner images are formed (carried) on the photosensitive drums 51. The toner images of respective colors formed on the respective photosensitive drums 51 are sequentially transferred onto the intermediate transfer belt 63 with being overlapped. Then, as the sheet S conveyed from the feeing unit 30 passes to the transfer position between the intermediate transfer belt 63 and the secondary transfer roller 65, the toner images on the intermediate transfer belt 63 are transferred onto the sheet S.

The fixing unit 70 is provided at the rear-upper part of the transfer unit 60 and includes a heating roller 71, a pressing roller 72 which is arranged to oppose the heating roller 71 and presses the heating roller 71 and discharge rollers 73 which discharge the sheet S after the fixing to the outside of the apparatus min body 10. In the fixing unit 70, as the sheet S having the toner images transferred thereto passes between the heating roller 71 and the pressing roller 72, the toner images are heat-fixed and the sheet is discharged to the outside of the apparatus main body 10 by the discharge roller 73 and is then placed and stacked on the sheet discharge tray 12.

<Structures of Process Cartridge 50 and Cartridge Holder 100>

Figure 4:
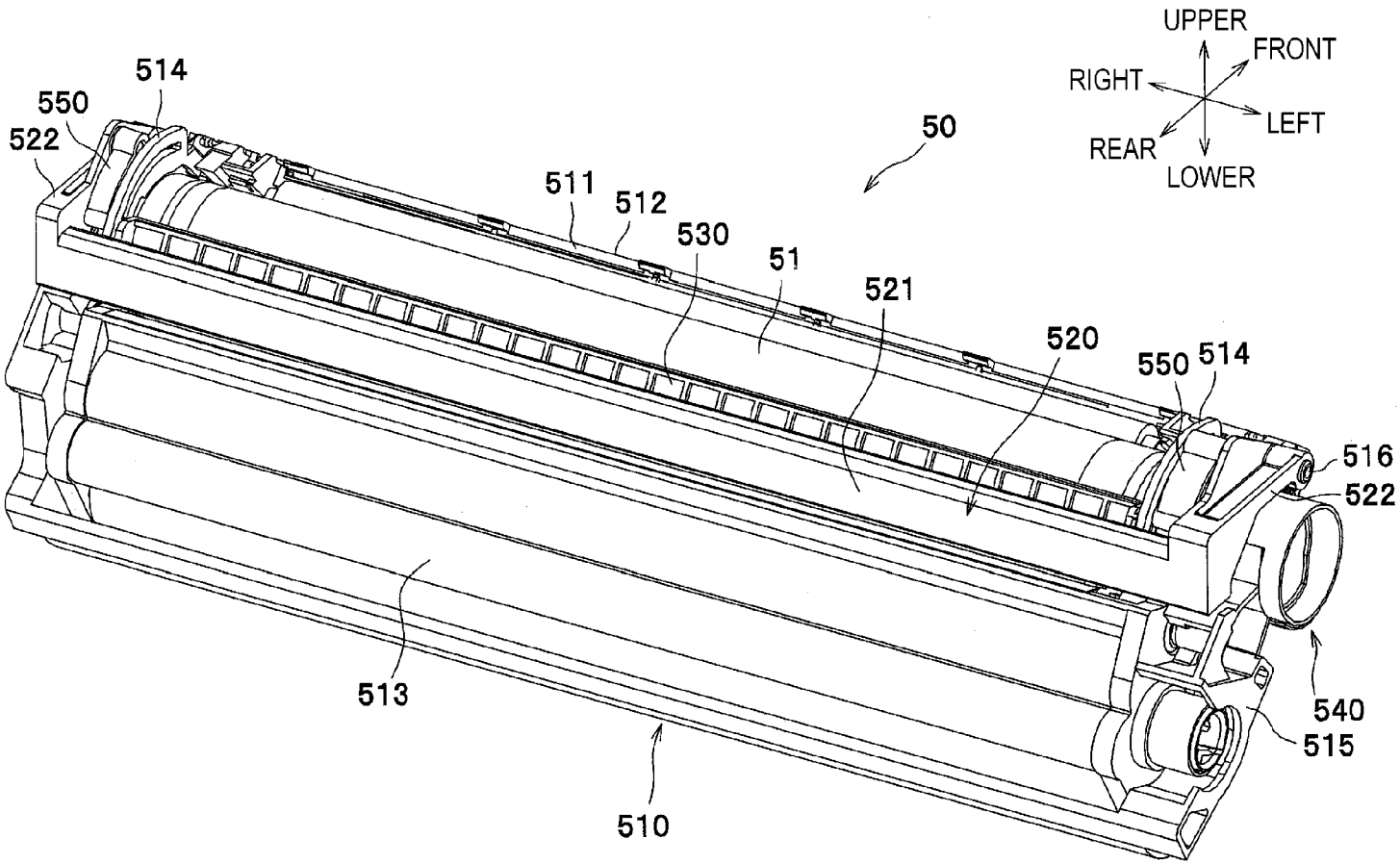
FIG. 4 is a perspective view of a process cartridge when a handle member is located at a retreat position.
Figure 5:
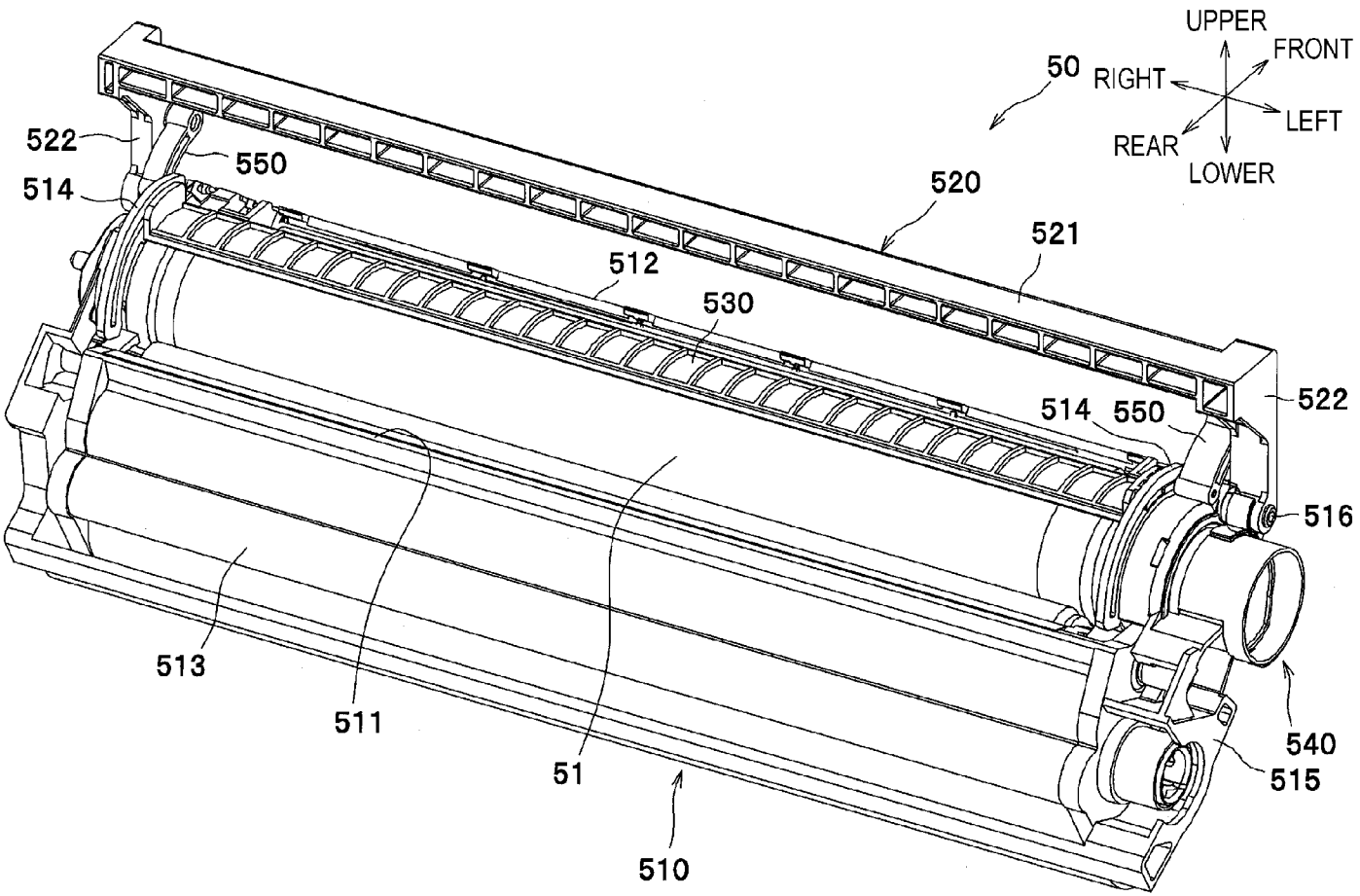
FIG. 5 is a perspective view of the process cartridge when the handle member is located at a protrusion position.

As shown in FIGS. 4 and 5, the process cartridge 50 includes a casing 510, a handle member 520, a cover member 530 and a part of an interlocking mechanism 540.

An upper part of the casing 510 is formed with an opening 511 which is open upward. Accordingly, the upper part of the photosensitive drum 51 is exposed upward through the opening 511, so that the photosensitive drum 51 can contact the intermediate transfer belt 63. Specifically, the opening 511 is formed by an upper end of a front wall 512 of the casing 510, an upper end of a rear wall 513 and inner surfaces of a pair of support members 514 which have a circular arc section and slidably support left and right end portions of the cover member 530 along a circumferential surface of the photosensitive drum 51.

The handle member 520 is rotatably supported by support shafts 516 provided on left and right walls 515 of the casing 510 such that the handle member 520 can be displaced between a protrusion position (position of FIG. 5) where the handle member 520 protrudes upward above the opening 511 and a retreat position (position of FIG. 4) where the handle member is rotated down (comes down) by about 90° from the protrusion position to be below the protrusion position. The support shafts 516 are formed at positions different from a rotation center of the photosensitive drum 51. That is, the handle member 520 is rotated about an axis different from the photosensitive drum 51.

Specifically, the handle member 520 includes a holding part 521 opposing the opening 511 at the protrusion position and a pair of arm parts 522 extending from both ends of the holding part 521 toward the opening 511. The holding part 521 is formed at a position which is downward from the pair of arm parts 522 when the handle member 520 is at the retreat position such that the holding part 521 is located below the upper part of the photosensitive drum 51.

Therefore, it is possible to prevent the intermediate transfer belt 63 and the holding part 521 from interfering with each other. In the meantime, the pair of arm parts 522 are located at outer positions than a width (left-right length) of the intermediate transfer belt 63 in the left-right direction. Therefore, even when the arm parts are positioned above the photosensitive drum 51, the arm parts do not interfere with the intermediate transfer belt 63.

A lower end of each arm part 522 is rotatably supported to the support shaft 516 and a substantially center portion of the arm part is connected to the cover member 530 via a link arm 550 (an example of a link mechanism). The link arm 550 transfers power from the handle member 520 to the cover member 530, and has a circular arc section. End portions of the link arm 550 are rotatably connected to the handle member 520 and the cover member 530, respectively.

Figure 6:
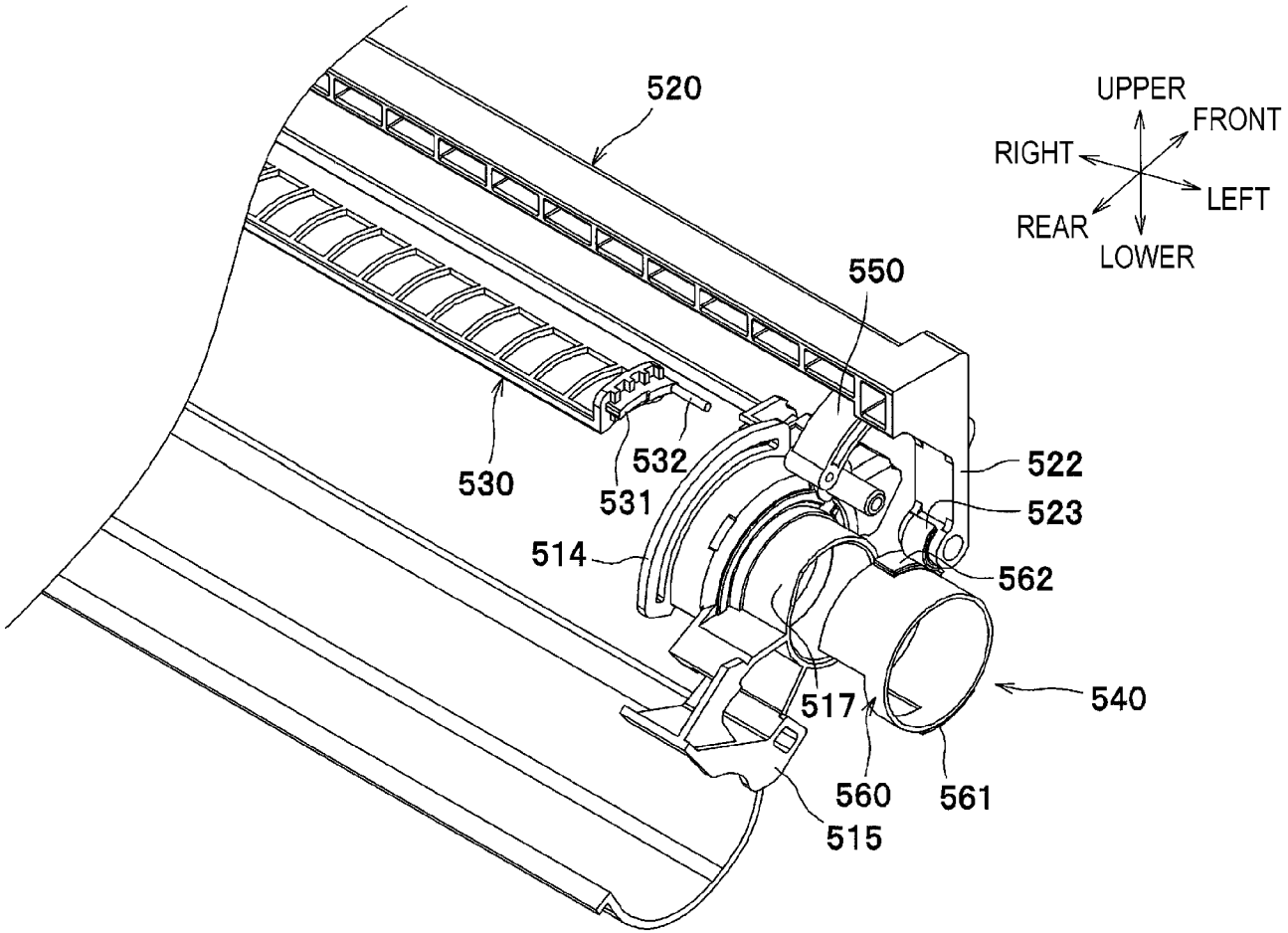
FIG. 6 is an exploded perspective view showing an interlocking mechanism provided to the process cartridge.

The cover member 530 is configured to be moved between a close position (position of FIG. 5) of covering the upper part of the photosensitive drum 51 exposed upward from the opening 511 and an open position (position of FIG. 4) of opening the upper part of the photosensitive drum 51. Specifically, the cover member 530 has a circular arc section along the circumferential surface of the photosensitive drum 51. Both ends of the cover member are formed with slider parts 531 which protrude outward in the left-right direction and extend in a circular arc shape, as shown in FIG. 6. Also, a protrusion pin 532 is formed at a front end portion of the slider part 531. The protrusion pin 532 protrudes outward in the left-right direction from the front end portion.

The slider parts 531 are supported by circular arc holes, which are formed in the support members 514 having a circular arc section, so that the cover member 530 can slide in a circular arc shape about a rotational axis of the photosensitive drum 51. The protrusion pins 532 are connected to rear end portions of the link arms 550 through the circular arc holes of the support members 514, so that the cover member 530 is moved in conjunction with the handle member 520 via the link arms 550.

As shown in FIG. 4, the cover member 530 is accommodated in an inner space of the handle member 520 having a substantially U shape at the open position. In other words, lengths and positions of the link arms 550 are designed such that the cover member 530 is accommodated in a space formed by the holding part 521 and arm parts 522 of the handle member 520 at the open position.

Figure 7:
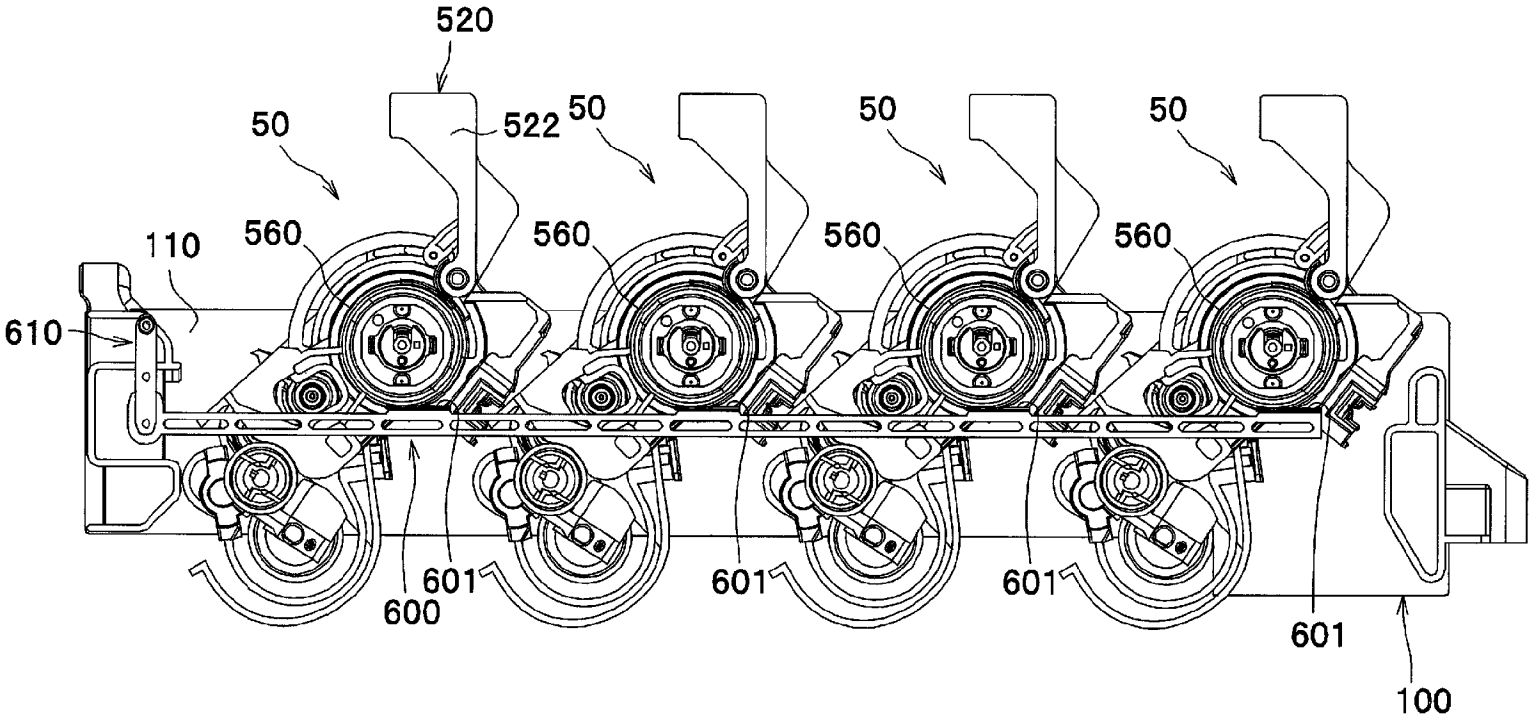
FIG. 7 is a view showing a rack member and an operation lever.

The interlocking mechanism 540 is a mechanism which displaces the handle member 520 and the cover member 530 in conjunction with the moving of the cartridge holder 100 with respect to the apparatus main body 10. Specifically, as shown in FIGS. 6 and 7, the interlocking mechanism 540 is configured by an operation lever 610 and a rack member 600, which are provided to the cartridge holder 100, and an intermittent gear 560, the arm parts 522 of the handle member 520, the link arm 550 and the protrusion pins 532 of the cover member 530, which are provided to each of the process cartridges 50. The interlocking mechanism 540 is respectively provided at left and right sides of the process cartridge 50.

Figure 8A:
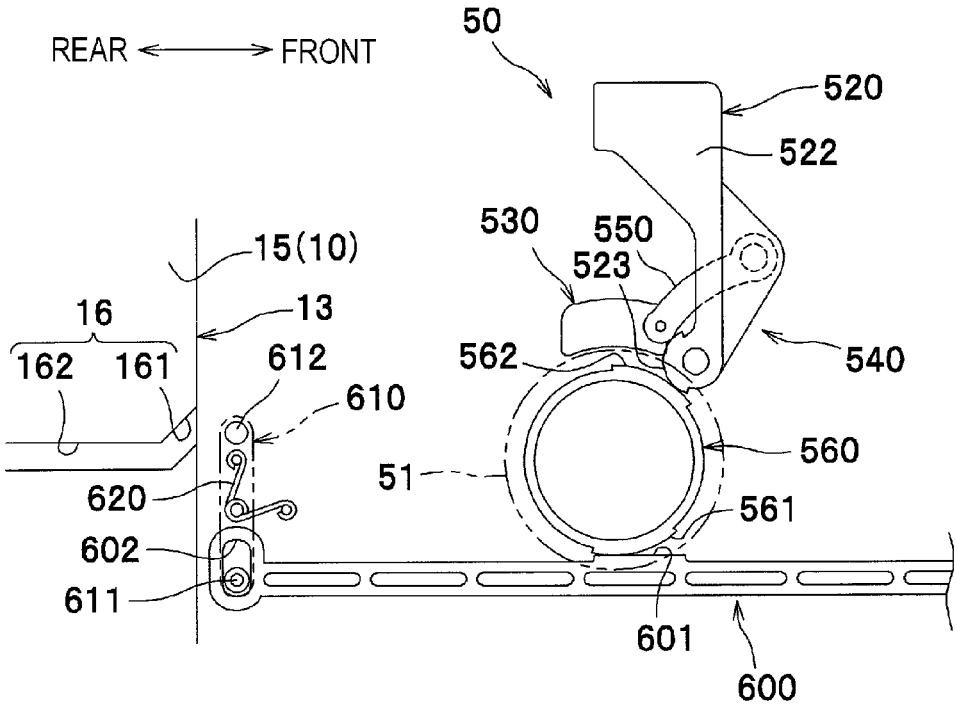

As shown in FIG. 8A, the operation lever 610 is rotatably supported at its substantially central part thereof to a side wall 110 (refer to FIG. 7) of the cartridge holder 100. A lower end of the operation lever 610 is provided with a first engagement protrusion 611 which protrudes outward in the left-right direction and is engaged with a long hole 602 of the rack member 600 and an upper end thereof is provided with a second engagement protrusion 612 which protrudes outward in the left-right direction beyond the side wall 110 and is engaged with an engagement recess 16 formed in each of left and right side walls 15 of the apparatus main body 10. The engagement recess 16 is a recess which is open inward in the left-right direction and has an inclined recess 161 which extends rearward and downward obliquely from a front end of the side wall 15 and a horizontal recess 162 which extends rearward substantially horizontally from a rear end of the inclined recess 161.

An upper portion of the operation lever 610, which is above a rotation center of the operation lever, is always urged to an initial position of FIG. 8A by an urging member such as torsion coil spring 620 provided to the cartridge holder 100. Thereby, when the cartridge holder 100 is located at the outer position, it is possible to return the operation lever 610 to the initial position by urging force of the torsion coil spring 620 even though a user moves the operation lever 610 by mistake. In the meantime, a regulation member which regulates the operation lever 610 from being moved rearward may be provided at a rear side of the upper end portion of the operation lever 610 and the operation lever 610 may be urged toward the regulation member by the torsion coil spring 620.

Figure 8B:
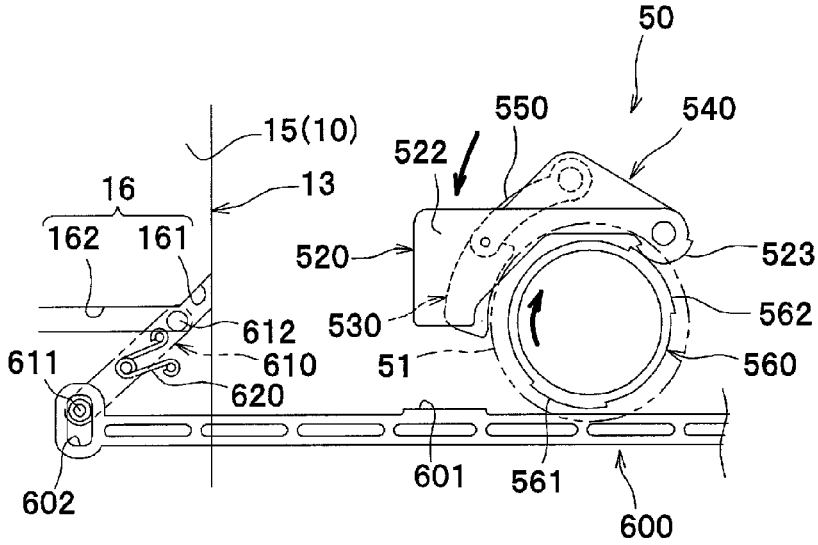

With the operation lever 610 configured as described above, when moving the cartridge holder 100 from the outer position to the inner position in the apparatus main body 10, as shown in FIGS. 8A and 8B in this order, the second engagement protrusion 612 of the operation lever 610 is engaged with an upper surface of the inclined recess 161 and pressed downward and the operation lever 610 is rotated in a clockwise direction. As the operation lever 610 is rotated in the clockwise direction, the rack member 600 is pulled by the first engagement protrusion 611 of the operation member 610, so that the rack member 600 is moved rearward.

To the contrary, as shown in FIGS. 8B and 8A in this order, when moving the cartridge holder 100 from the inner position to the outer position, the second engagement recess 612 of the operation lever 610 is engaged with a lower surface of the inclined recess 161 and pressed upward and the urging force of the torsion coil spring 620 is applied, no that the operation lever 610 is rotated in a counterclockwise direction. As the operation lever 610 is rotated in the counterclockwise direction, the rack member 600 is pressed forward by the first engagement protrusion 611, so that the rack member 600 is moved forward.

As shown in FIG. 7, the rack member 600 extends in the front-rear direction and has a length (a length from the intermittent gear 560 at one side in the alignment direction to the intermittent gear 500 at the other side) which overlaps with at least the four intermittent gears 560, when seen from the upper-lower direction. The rack member 600 is respectively arranged at the left and right sides such that the plurality of process cartridges 50 is provided therebetween, and is slidably supported in the front-rear direction (moving direction of the cartridge holder 100) at the inner side between the left and right walls 110 of the cartridge holder 100.

The rack member 600 is formed with four rack teeth 601 which are respectively meshed with the four intermittent gears 560. Thereby, the respective intermittent gears 560 are rotated in conjunction with the moving of the rack member 600 in the front-rear direction. Also, as shown in FIG. 8A, a rear end portion of the rack member 600 is formed with the long hole 602 extending in the upper-lower direction, and the first engagement protrusion 611 of the operation lever 610 is engaged in the long hole 602.

The intermittent gear 560 (an example of a gear mechanism) is a cylindrical gear which transfers power from the rack member 600 to the handle member 520. As shown in FIG. 6, the intermittent gear 560 is rotatably supported to cylindrical support member 517 formed on each of the left and right walls 515 of the process cartridge 50, so that the intermittent gear 560 can be rotated about the rotational axis of the photosensitive drum 51. Specifically, the intermittent gear 560 has a first gear part 561 which is engaged with the rack tooth 601 of the rack member 600 and a second gear part 562 which is engaged with an arm-side gear part 523 formed below the arm part 522 of the handle member 520.

By the interlocking mechanism 540 configured as described above, when the cartridge holder 100 is moved from the outer position to the inner position, as shown in FIGS. 8A and 8B, the operation lever 610 is rotated in the clockwise direction, so that the rack member 60 is moved rearward. Thereby, the intermittent gear 560 engaged with the rack member 600 is rotated in the clockwise direction and the handle member 520 is rotated in the counterclockwise direction and is thus located at the retreat position. As the handle member 520 that is rotated as described above presses the cover member 530 via the link arm 550, the cover member 530 is moved in the counterclockwise direction and is thus located at the open position.

Also, when the cartridge holder 100 is moved from the inner position to the outer position, the respective members are moved in reverse to the above-described operation, so that the handle member 520 is located at the protrusion position and the cover member 530 is located at the close position.

That is, as shown in FIGS. 8A and 8B in this order, the interlocking mechanism 540 displaces the handle member 520 to the retreat position and the cover member 530 to the open position, in conjunction with the moving of the cartridge holder 100 to the inner position with respect to the apparatus main body 10. Also, as shown in FIGS. 8B and 8A in this order, the interlocking mechanism 540 displaces the handle member 520 to the protrusion position and the cover member 530 to the close position, in conjunction with the moving of the cartridge holder 100 to the outer position with respect to the apparatus main body 10.

Thereby, when the cartridge holder 100 is located at the inner position, the handle member 520 is rotated down (comes down) to the retreat position. Therefore, it is possible to reduce the accommodation space of the cartridge holder 100 in the apparatus main body 10.

When all the process cartridges 50 are withdrawn to the outer position from the opening 13 (apparatus main body 10), the interlocking mechanisms 540 displace the handle members 520 and cover members 530 of the respective process cartridges 50 located at the outer position. That is, in this illustrative embodiment, the inclined recess 161 for operating the operation lever 610 is provided adjacent to the opening 13 and the operation lever 610 is arranged at the rear end portion of the rack member 600 which extends more rearward than the most rearward process cartridge 50. Therefore, before the most rearward process cartridge 50 is mounted into the apparatus main body 10, the operation lever 610 and the rack member 600 are moved to operate the mechanisms (intermittent gears 560 and the like) of the process cartridges 50 at the outside of the apparatus main body 10.

Therefore, the handle members 520 is rotated down (comes down) to the retreat positions before the respective process cartridges 50 are mounted into the apparatus main body 10 from the opening 13, so that it is possible to reduce the size of the opening 13 and the space in the apparatus main body 10 for moving the cartridge holder 100.

As described above, according to this illustrative embodiment, following effects may be achieved.

When the cartridge holder 100 is moved to the inner position, the handle member 520 is displaced to the retreat position. Accordingly, it is possible to reduce the size of the apparatus main body 10, compared to a configuration where the handle member is accommodated in the apparatus main body with protruding upward.

When the cartridge holder 100 is moved to the outer position, the cover member is moved to the close position, thereby covering the upper part of the photosensitive drum 51. Therefore, when the user withdraws the process cartridge 50 with holding the handle member 520, it is possible to suppress a finger of the user from contacting the upper part of the photosensitive drum 51 and thus the photosensitive drum 51 from being damaged.

The handle members 520 conic down to the retreat positions before the respective process cartridges 50 are mounted into the apparatus main body 10 from the opening 13. Therefore, it is possible to reduce the size of the apparatus main body 10, compared to a configuration where the handle members 520 come down to the retreat positions after the respective process cartridges 50 are introduced into the apparatus main body 10.

The cover member 530 has the circular arc section along the circumferential surface of the photosensitive drum 51 and slides in the circular arc shape about the rotational axis of the photosensitive drum 51. Therefore, it is possible to make the process cartridge 50 smaller in the radial direction, compared to a configuration where the cover having a shape other than the circular arc shape is rotated.

Since all the intermittent gears 560 are enabled to engage with one rack member 600, it is possible to simplify the structure, compared to a structure where a plurality of rack members are respectively provided for intermittent gears 560.

The cover member 530 is accommodated into the inner space of the handle member 520 having a substantially U shape at the open position. Therefore, it is possible to effectively use a useless inner space of the handle member 520 and to thus improve the compactness.

While the present invention has been shown and described with reference to certain illustrative embodiments thereof, it will be understood by those skilled in the art that various changes in form and details may be made therein without departing from the spirit and scope of the invention as defined by the appended claims.

In the above illustrative embodiment, the respective handle members 520 and respective cover members 530 of the process cartridges 50 are simultaneously displaced by one rack member 600. However, the present invention is not limited thereto. For example, the interlocking mechanism may be configured such that the respective handle members and respective cover members are displaced at different timings.

Figure 9:
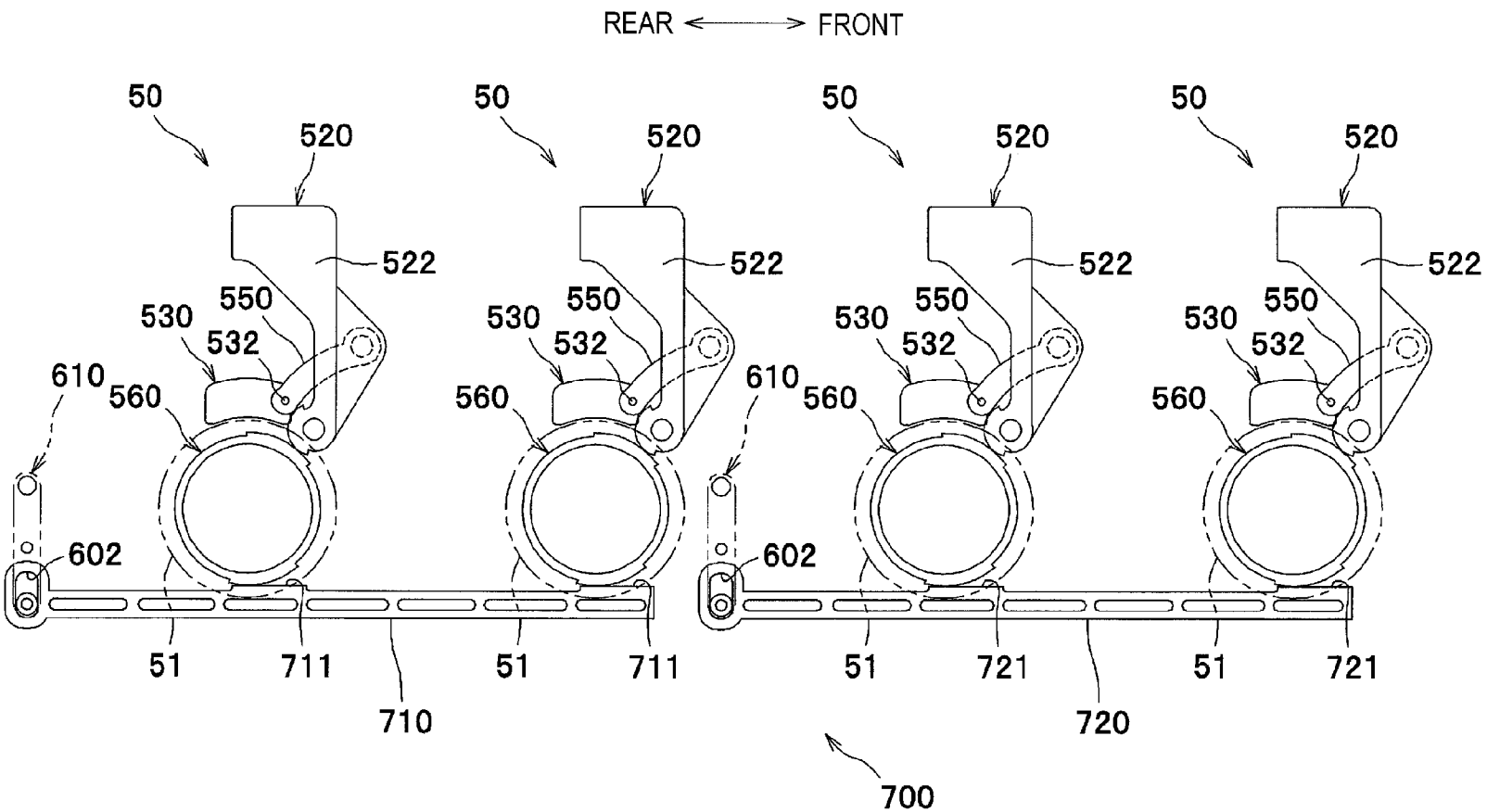
FIG. 9 is a view showing an interlocking mechanism according to a first modified illustrative embodiment.
Figure 10:
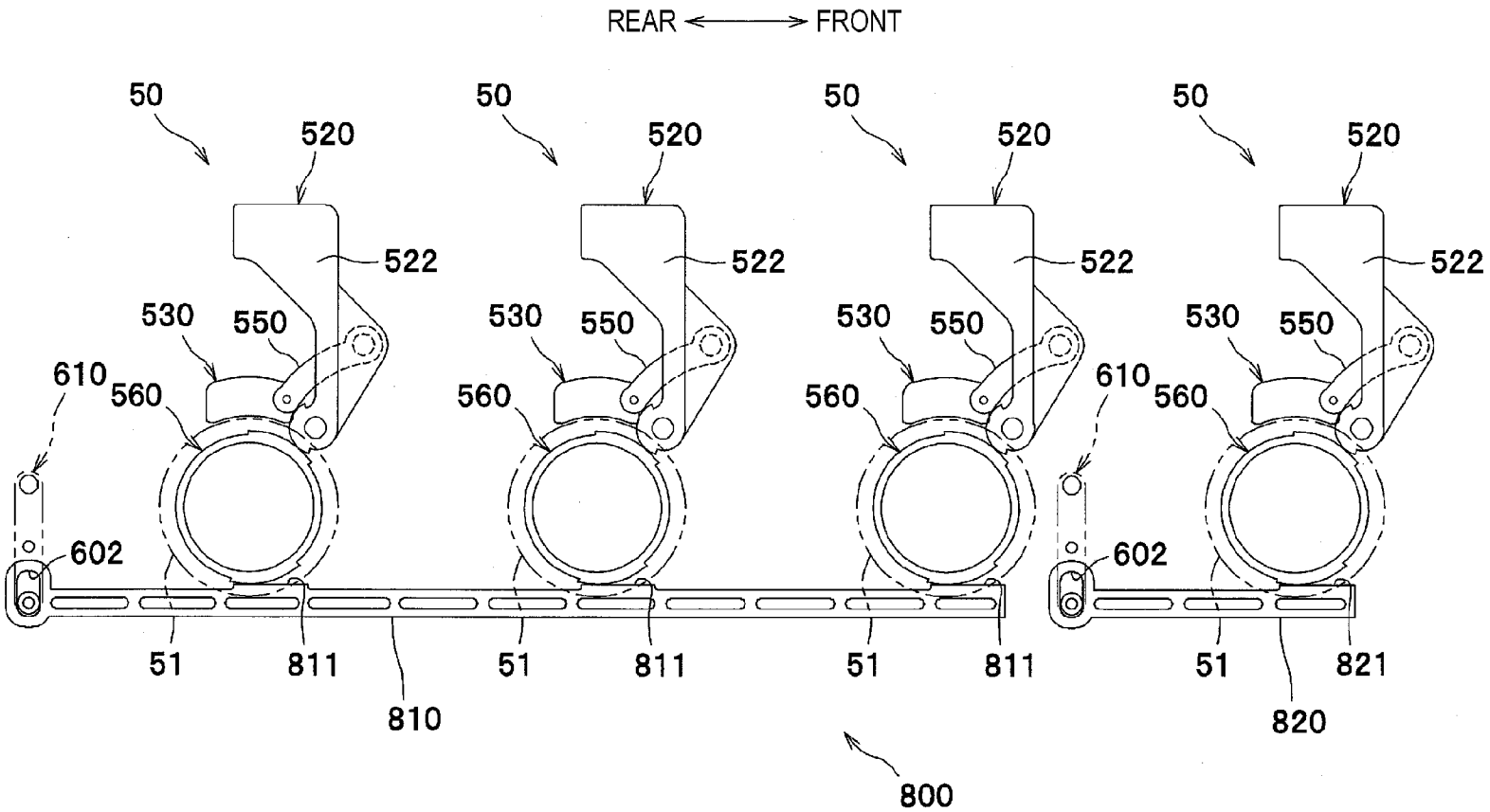
FIG. 10 is a view showing an interlocking mechanism according to a second modified illustrative embodiment.
Figure 11:
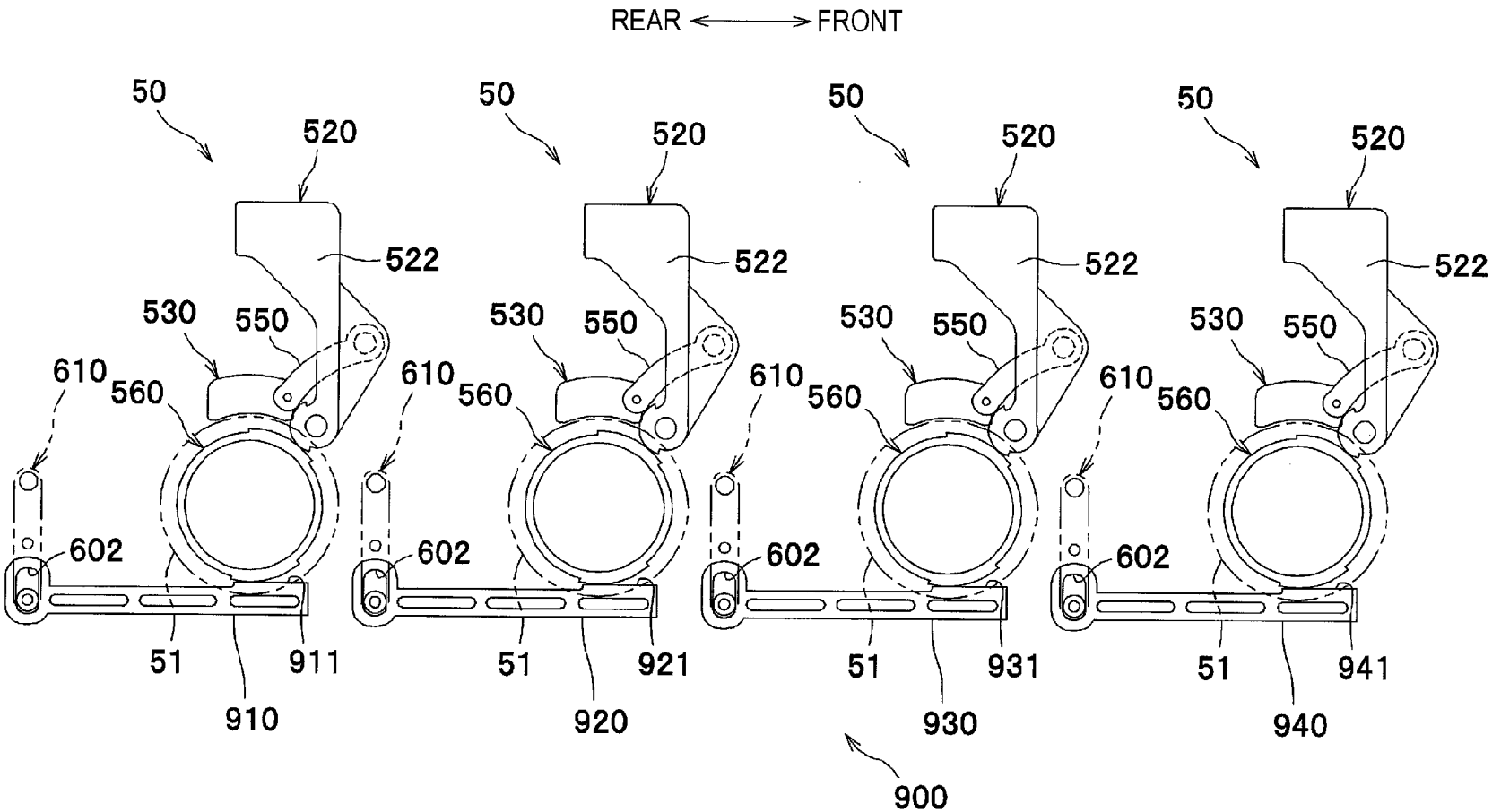
FIG. 11 is a view showing an interlocking mechanism according to a third modified illustrative embodiment.

In the meantime, when configuring the timings different, it may be advantageous to configure the interlocking mechanism such that when the cartridge holder is moved from the outer position to the inner position, the handle members and cover members of the process cartridges are displaced in order from a process cartridge closer to the inside of the apparatus main body. Specifically, interlocking mechanisms 700, 800, 900 as shown in FIGS. 9 to 11 may be employed. In the below descriptions, the same configurations as the above illustrative embodiment are indicated with the same reference numerals and the descriptions thereof are omitted.

As shown in FIG. 9, the interlocking mechanism 700 according to a first modified illustrative embodiment has the intermittent gears 560, the arm parts 522 of the handle members 520, the link arms 550 and the protrusion pins 532 of the cover member 530, which are the same as the above illustrative embodiment. The interlocking mechanism 700 has a first rack member 710 and a second rack member 720, which are divided in the front-rear direction, differently from the above illustrative embodiment, and the two operation levers 610, which are the same as the above illustrative embodiment, in correspondence to the respective rack members 710, 720.

The first rack member 710 has two rack teeth 711 which are respectively meshed with two (predetermined number) rear intermittent gears 560. The second rack member 720 has two rack teeth 711 which are respectively meshed with two (remaining two) front intermittent gears 560. The rear end portions of the respective rack members 710, 720 are formed with the long holes 602 same as the above illustrative embodiment and the operation levers 601 are engaged with the long holes 602.

In the above structure, when the cartridge holder 100 is moved from the outer position to the inner position, the rear operation lever 610 is first engaged with the engagement recess 16 (refer to FIG. 8) of the apparatus main body 10, no that the two rear handle members 520 and cover members 530 are respectively moved to the retreat positions and the open positions. When the cartridge holder 100 is further moved toward the inner position from the positions, the two front cover members 530 are left at the close positions until the front operation lever 610 reaches the engagement recess 16.

Accordingly, in the above structure, the two front cover members 530 can be kept at the close position up to the proximity of the opening 13 (refer to FIG. 8), compared to the above illustrative embodiment in which all the cover members 530 are opened at the same time. Hence, it is possible to suppress the dusts and the like from being introduced into the two front process cartridges 50.

In the interlocking mechanism 800 shown in FIG. 10, the first rack member 710 and the second rack member of the first modified illustrative embodiment are partially modified. Specifically, a first rack member 810 of the second modified illustrative embodiment has three rack teeth 811 which are respectively meshed with three (predetermined number) rear intermittent gears 560. Also, a second rack member 820 has one rack tooth 821 which is meshed with the one (remaining one) most forward intermittent gear 560.

Also in the interlocking mechanism 800, the same effect as the first modified illustrative embodiment can be achieved. Also, according to the interlocking mechanism 800, the most forward handle member 520 is independently moved separately from the other three handle members 520. Accordingly, when black toner, which is most frequently used, is put in the most forward process cartridge 50, it is possible to set upright the handle member 520 just by withdrawing a little the cartridge holder 100 from the opening 13 and thus the user can easily replace the black process cartridge 50.

The interlocking mechanism 900 shown in FIG. 11 has four rack members 910, 920, 930, 940 in correspondence to the four (plural) process cartridges 50. The respective rack members 910, 920, 930, 940 have rack teeth 911, 921, 931, 941 which are respectively meshed with the intermittent ears 560. Also, in this structure, the operation levers 610 are respectively provided in correspondence to the four rack members 910, 920, 930, 940.

In the interlocking mechanism 900, when moving the cartridge holder 100 from the outer position to the inner position, it is possible to keep the respective cover members 530 at the close position until the cover members respectively reach the proximity of the opening 13 (refer to FIG. 8). Therefore, it is possible to further suppress the dusts and the like from being introduced into the respective process cartridges 50. Further, for example, when a user wants to replace the second process cartridge 50 from the front, the user has only to withdraw the cartridge holder 100 until the second process cartridge 50 from the front comes out from the apparatus main body 10. Accordingly, it is possible to easily perform the replacing operation of the process cartridges 50.

In the above illustrative embodiment, the process cartridge 50 is exemplified, as a cartridge. However, the present invention is not limited thereto. For example, for a structure where a developing cartridge having a developing roller is detachably attached to a drum cartridge having a photosensitive drum, the inventive concept of the present invention can be applied to the drum cartridge or developing cartridge. In the meantime, when the inventive concept is applied to the developing cartridge, the developing roller corresponds to the developer carrier.

In the above illustrative embodiment, there is employed the structure where the opening 511 formed at the upper part of the casing 510 is not completely covered by the cover member 530. However, the present invention is not limited thereto. For example, a structure where the opening is completely covered by the cover member may be adopted.

In the above illustrative embodiment, the cartridge holder 100 is also provided with a part (rack member 600 and the like) of the interlocking mechanism 540. However, the present invention is not limited thereto. For example, the interlocking mechanism may be provided only to the cartridge. Specifically, for example, the interlocking mechanism may be configured while omitting the rack member 600 and the operation lever 610 of the interlocking mechanism 540 of the above illustrative embodiment. In this case, for example, the handle member 520 may be moved to the retreat position by bringing a part of the handle member 520 into contact with a part of the apparatus main body, and an urging member which urges the handle member 520 to the protrusion position all the time may be provided to return the handle member 520 to the protrusion position.

The interlocking mechanism is not limited to the structures shown in the above illustrative embodiment and the modified illustrative embodiments shown in FIGS. 9 to 11. For example, the interlocking mechanism may be configured while omitting the operation lever 610 of the interlocking mechanism 540 in the above illustrative embodiment. In this case, it is possible to move the handle member 520 to the retreat position by reversely configuring the mounting direction of the cartridge holder 100 and bringing a part of the rack member 600 into contact with a part of the apparatus main body 10. Also, it is possible to return the handle member 520 to the protrusion position by providing an urging member which urges the handle member 520 to the protrusion position all the time.

In the above illustrative embodiment one intermittent gear 560 is exemplified as the gear mechanism. However, the present invention is not limited thereto. For example, the gear mechanism may be configured by a plurality of gears, a power transmission belt and the like.

In the above illustrative embodiment, one link arm 550 is exemplified as the link mechanism. However, the present invention is not limited thereto. For example, the link mechanism may be configured by a plurality of link arms, a cam and the like.

In the above illustrative embodiment, the color printer 1 is exemplified as the image forming apparatus. However, the present invention is not limited thereto. For example, the inventive concept of the present invention can be applied to the other image forming apparatuses such as copier, complex machine and the like.

What is claimed is:

1. An image forming apparatus comprising:

an apparatus main body;

a plurality of cartridges which are aligned in an alignment direction; and a cartridge holder which is configured to integrally support the plurality of cartridges and is configured to be moved in the alignment direction between an outer position located at an outside of the apparatus main body and an inner position located at an inside of the apparatus main body, wherein each of the cartridges includes:

a casing having an opening which is open upward;

a developer carrier which is configured to carry developer and is exposed upward through the opening;

a handle member which is configured to be displaced between a protrusion position where the handle member protrudes upward above the opening and a retreat position where the handle member is below the protrusion position; and a cover member which is configured to be displaced between a close position of covering an upper part of the developer carrier and an open position of opening the upper part of the developer carrier, wherein among the cartridges and the cartridge holder, at least the cartridges are provided with an interlocking mechanism which is configured to displace each of the handle members and the cover members in conjunction with moving of the cartridge holder with respect to the apparatus main body, wherein the interlocking mechanism is configured to displace each of the handle members to the retreat position and each of the cover members to the open position in conjunction with the moving of the cartridge holder to the inner position with respect to the apparatus main body, and wherein the interlocking mechanism is configured to displace each of the handle members to the protrusion position and each of the cover members to the close position in conjunction with the moving of the cartridge holder to the outer position with respect to the apparatus main body.

2. The image forming apparatus according to claim 1, wherein the apparatus main body has an opening for withdrawing the cartridge holder to the outside, and wherein when a cartridge is located at an outside position from the opening, the interlocking mechanism is configured to displace the handle member and cover member of the cartridge located at the outside position.

3. The image forming apparatus according to claim 2, wherein when the cartridge holder is moved from the outer position to the inner position, the interlocking mechanism is configured to displace the handle members and the cover members of the cartridges in order from a cartridge closer to the inside of the apparatus main body.

4. The image forming apparatus according to claim 1, wherein in each of the cartridges, the cover member has a circular arc section along a circumferential surface of the developer carrier and is configured to slide in a circular arc shape about a rotational axis of the developer carrier.

5. The image forming apparatus according to claim 1, wherein each of the developer carriers is a photosensitive drum configured to carry a developer image, and wherein a belt is arranged above the photosensitive drums.

6. The image forming apparatus according to claim 1, wherein the interlocking mechanism is provided to both the cartridges and the cartridge holder.

7. The image forming apparatus according to claim 1, wherein the interlocking mechanism includes:

a rack member which is provided to the cartridge holder to be movable in a moving direction of the cartridge holder, and which is configured to engage with the apparatus main body to be moved in one direction when the cartridge holder is moved to the inner position and to be moved in a direction opposite to the one direction when the cartridge holder is moved to the outer position;

a plurality of gear mechanisms which are provided to the plurality of cartridges, respectively, and each of which is configured to transfer power from the rack member to the handle member of the corresponding cartridge; and a plurality of link mechanisms which are provided to the plurality of cartridges, respectively, and each of which is configured to transfer power from the handle member to the cover member of the corresponding cartridge, and wherein the rack member extends in the moving direction to mesh with the plurality of gear mechanisms.

8. The image forming apparatus according to claim 7, wherein in each of the cartridges, the handle member has a holding part which opposes the opening and a pair of arm parts which extend from both ends of the holding part toward the opening, and the link mechanism is configured such that the cover member is accommodated in a space thrilled by the holding part and the arm parts of the handle member at the open position.

9. The image forming apparatus according to claim 1, wherein the interlocking mechanism includes:

a rack member which is provided to the cartridge holder to be movable in a moving direction of the cartridge holder, and which is configured to engage with the apparatus main body to be moved in one direction when the cartridge holder is moved to the inner position and to be moved in a direction opposite to the one direction when the cartridge holder is moved to the outer position;

a plurality of gear mechanisms which are provided to the plurality of cartridges, respectively, and each of which is configured to transfer power from the rack member to the handle member of the corresponding cartridge; and a plurality of link mechanisms which are provided to the plurality of cartridges, respectively, and each of which is configured to transfer power from the handle member to the cover member of the corresponding cartridge, and wherein the rack member includes a first rack member which meshes with a predetermined number of gear mechanisms of the plurality of gear mechanisms and a second rack member which meshes with a remaining gear mechanism of the plurality of gear mechanisms.

10. The image forming apparatus according to claim 9, wherein in each of the cartridges, the handle member has a holding part which opposes the opening and a pair of arm parts which extend from both ends of the holding part toward the opening, and the link mechanism is configured such that the cover member is accommodated in a space thrilled by the holding part and the arm parts of the handle member at the open position.

11. The image forming apparatus according to claim 1, wherein the interlocking mechanism includes:

a rack member which is provided to the cartridge holder to be movable in a moving direction of the cartridge holder, and which is configured to engage with the apparatus main body to be moved in one direction when the cartridge holder is moved to the inner position and to be moved in a direction opposite to the one direction when the cartridge holder is moved to the outer position;

a plurality of gear mechanisms which are provided to the plurality of cartridges, respectively, and each of which is configured to transfer power from the rack member to the handle member of the corresponding cartridge; and a plurality of link mechanisms which are provided to the plurality of cartridges, respectively, and each of which is configured to transfer power from the handle member to the cover member of the corresponding cartridge, and wherein the rack member includes a plurality of rack members in correspondence to the plurality of cartridges, and each of the rack members meshes with the gear mechanism of the corresponding cartridge.

12. The image forming apparatus according to claim 11, wherein in each of the cartridges, the handle member has a holding part which opposes the opening and a pair of arm parts which extend from both ends of the holding part toward the opening, and the link mechanism is configured such that the cover member is accommodated in a space formed by the holding part and the arm parts of the handle member at the open position.

13. A cartridge unit configured to be mounted in an apparatus main body of an image forming apparatus, the cartridge unit comprising:

a plurality of cartridges which are aligned in an alignment direction; and a cartridge holder which is configured to integrally support the plurality of cartridges and is configured to be moved in the alignment direction between an outer position located at an outside of the apparatus main body and an inner position located at an inside of the apparatus main body, wherein each of the cartridges includes:

a casing having an opening which is open upward;

a developer carrier which is configured to carry developer and is exposed upward through the opening;

a handle member which is configured to be displaced between a protrusion position where the handle member protrudes upward above the opening and a retreat position where the handle member is below the protrusion position; and a cover member which is configured to be displaced between a close position of covering an upper part of the developer carrier and an open position of opening the upper part of the developer carrier, wherein among the cartridges and the cartridge holder, at least the cartridges are provided with an interlocking mechanism which is configured to displace each of the handle members and the cover members in conjunction with moving of the cartridge holder with respect to the apparatus main body, wherein the interlocking mechanism is configured to displace each of the handle members to the retreat position and each of the cover members to the open position in conjunction with the moving of the cartridge holder to the inner position with respect to the apparatus main body, and wherein the interlocking mechanism is configured to displace each of the handle members to the protrusion position and each of the cover members to the close position in conjunction with the moving of the cartridge holder to the outer position with respect to the apparatus main body.

14. A cartridge comprising:

a casing having an opening which is open upward;

a developer carrier which is configured to carry developer and is exposed upward through the opening;

a handle member which is configured to be displaced between a protrusion position where the handle member protrudes upward above the opening and a retreat position where the handle member is below the protrusion position;

a cover member which is configured to be displaced between a close position of covering an upper part of the developer carrier and an open position of opening the upper part of the developer carrier; and an interlocking mechanism which is configured to displace the handle member and the cover member while engaging with an external part, wherein the interlocking mechanism includes:

a gear mechanism which is configured to engage with the external part to transfer power to the handle member; and a link mechanism which is configured to transfer power from the handle member to the cover member, wherein the interlocking mechanism is configured to displace the handle member to the retreat position and the cover member to the open position by the gear mechanism engaging with the external part moving in a first direction, and wherein the interlocking mechanism is configured to displace the handle member to the protrusion position and the cover member to the close position by the gear mechanism engaging with the external part moving in a second direction opposite to the first direction.

* * * * *